United States Patent [19]

Brown

[11] Patent Number: 4,934,224

[45] Date of Patent: Jun. 19, 1990

[54] STRIP THREADING TENSION MONITORING SYSTEM

[75] Inventor: Robert L. Brown, Boston, Mass.

[73] Assignee: The Gillette Company, Boston, Mass.

[21] Appl. No.: 344,999

[22] Filed: Apr. 28, 1989

[51] Int. Cl.[5] ..... B23B 1/00

[52] U.S. Cl. ..... 82/47; 82/48; 72/132; 242/56 R; 493/24; 493/33; 83/424; 29/17.8

[58] Field of Search ..... 82/47, 48, 52; 72/132, 72/324; 242/56 R, 66; 493/24, 33; 83/424; 29/17 R

[56] References Cited

U.S. PATENT DOCUMENTS

| | | | |
|---|---|---|---|
| 1,701,889 | 2/1929 | Junker . | |
| 2,642,764 | 6/1953 | Porth . | |
| 2,821,492 | 1/1958 | Berdis . | |
| 2,916,956 | 12/1959 | Salomon . | |
| 3,262,182 | 7/1966 | Duret et al. . | |
| 3,330,497 | 7/1967 | Deschaine . | |
| 3,335,971 | 12/1967 | Vigor . | |
| 3,363,297 | 1/1968 | Snyder . | |
| 3,397,438 | 8/1968 | Montoro . | |
| 3,460,366 | 8/1969 | Musial et al. . | |
| 3,461,703 | 8/1969 | Ranney . | |
| 3,635,417 | 1/1972 | Kajiwara et al. . | |
| 3,746,229 | 7/1973 | Feller et al. . | |
| 3,918,654 | 11/1975 | Okubo et al. | 242/56 R |
| 4,070,739 | 1/1978 | Hague et al. . | |
| 4,075,747 | 2/1978 | Hague et al. . | |
| 4,085,496 | 4/1978 | Malkani et al. . | |
| 4,213,231 | 7/1980 | Middlemiss et al. . | |
| 4,274,315 | 6/1981 | Varner | 82/47 |
| 4,389,868 | 6/1983 | Strout | 72/132 |

FOREIGN PATENT DOCUMENTS

| | | |
|---|---|---|
| 80302624.4 | 8/1980 | European Pat. Off. . |
| 2001569 | 7/1978 | United Kingdom . |
| 2005067 | 7/1979 | United Kingdom . |

OTHER PUBLICATIONS

Publication of Robert Brown "Strip Fabrication from Powder Metal Using Hip/Peeling Techniques" (Jun. 1987).

Publication "Controlled Pull Creates Steel Strip" (Jul. 21, 1988).

Paper "Observations on the Peeling of a Composite GIN-B/420 Stainless Steel/42 Alloy Ring", Robert Brown (Jan. 5, 1988).

*Primary Examiner*—D. S. Meislin
*Assistant Examiner*—Mark F. Frazier
*Attorney, Agent, or Firm*—Hamilton, Brook, Smith & Reynolds

[57] ABSTRACT

The present invention relates to a system for monitoring tension of a peeled strip during threading of the strip onto a coil wrapping assembly. Sensors mounted on the coiler assembly monitor strip tension during threading such that a break in the strip triggers shutdown of the machine including withdrawal of the cutting tool from the billet to prevent damage to the tool.

14 Claims, 2 Drawing Sheets

STRIP THREADING TENSION MONITORING SYSTEM

BACKGROUND OF THE INVENTION

This invention relates to an electronic system for controlling apparatus for peeling and coiling a continuous strip of metal cut from a rotating billet, and more particularly, to a system for preventing damage to the billet and cutting apparatus if the strip breaks during threading of the machine.

Machines have been built to manufacture thin metal strips by continuously feeding or moving a cutting tool at a specific rate into the peripheral surface of a rotating metal billet so as to cut and peel a continuous metal strip from the billet surface.

Various types of steels and non-ferrous alloys have been formed into billets using casting techniques and the hot isostatic pressing of powders. The properties of the material employed, the technique used in forming the billet to be peeled, and the rate and conditions of peeling all contribute to the quality of the peeled strip. Peeled strips generally have a smooth and a rough side, the former being produced by the burnishing of the strip by the cutting tool as it advances into the billet. The roughness on the side opposite the cutting tool is determined by the prior history of billet processing as well as thickness of the strip, coolants, cutting tool geometry and composition. By optimizing the conditions under which peeling is performed it is possible to produce a continuous high quality strip of metal useful in a variety of applications.

Control systems have been developed whereby the surface speed of the billet, the speed of the peeled strip and the rate of advancement of the cutting tool into the surface of the billet can be adjusted to accurately control the thickness of the strip. U.S. Pat. No. 4,274,315 discloses such a control system wherein sensors are used to monitor the thickness of the strip and correct for unwanted variations thereof. A data processor can be used to gather and process information from the various system components to maximize operating speed of the machine and the quality of the strip that is produced.

Existing machines have utilized a tension producing coiling assembly as part of the peeling process. The coiling assembly can include a motor driven rotatable spindle with a wrapping mechanism to assist in the threading of the peel onto the coiler. The rotating spindle pulls and coils the metal strip as it is peeled from the billet.

The coiling assembly has a "running" mode for normal high-speed operation of the machine during peeling and a "threading" mode. The threading mode of the coiler consists of rotating the spindle at a relatively slow speed that is coupled to the speed of billet rotation. The initial threading of the strip also involves clamping the leading edge of the strip to the mandrel of the coiler assembly. However, the initially peeled strip material can be distorted due to the absence of tension. This distorted material is usually sheared and discarded before wrapping of the strip. Systems have been developed for shearing and wrapping the strip onto the mandrel during threading.

Threading is a critical step of the peeling process in which the initial portion of material that is cut from the billet is wrapped onto the coiler. A number of systems have been developed for the purpose of performing this initial wrap. For example, U.S. Pat. No. 4,389,868 describes such a belt wrapper assembly.

The initial portion of the strip is not under any applied tensile force. Consequently, the shape of the initial strip is poor and may be difficult to wrap on the coiler without producing a non-circular coil of strip. Also, when the strip is not under tension, greater shear deformation may occur at the cutting tool. This produces an initial strip that is thicker than strip under tension and may be more heavily cold worked to produce a brittle material that can break and disrupt the threading process.

During the threading of the peeling machine the cutting tool is advanced into the billet to maintain a predetermined thickness of the peeled strip. The coiler can be operated during threading at a constant speed relative to the spindle or in a constant tension mode. Thus, if the strip were to break during threading, many existing machines would continue to advance the tool into the billet before the operator could shut down the machine and initiate re-threading.

Peeling machines which couple the speed of the take-up coiler to the speed at which the tool advances into the billet during threading can result in damage to the billet, the tool and the hydrostatic spindle, if the strip breaks during threading. The coiler, no longer acting under the tension of the strip when it breaks, accelerates to a higher speed thereby causing the tool to dive into the billet.

SUMMARY OF THE INVENTION

The present invention is comprised of a control system that senses when the strip breaks during threading and then withdraws the cutting tool from the billet. This minimizes damage to the billet and the tool that can result from the breaking of the strip.

A first sensor is used to detect when the strip is initially wrapped onto the coiler spindle. The first sensor transmits a signal upon detection of wrapping that actuates a second sensor which detects the loss of torque when the strip breaks. In a preferred embodiment this is accomplished by sensing the torque in the shaft of the coiler drive upon detection of the initial wrapping of the strip. Thus, if a loss of torque suddenly occurs before the machine is placed in run mode, the present control system will override the tool feed motor and back the tool out of the billet. The operator then reinitiates threading of the system after discarding the broken strip.

DETAILED DESCRIPTION

Figure 1:
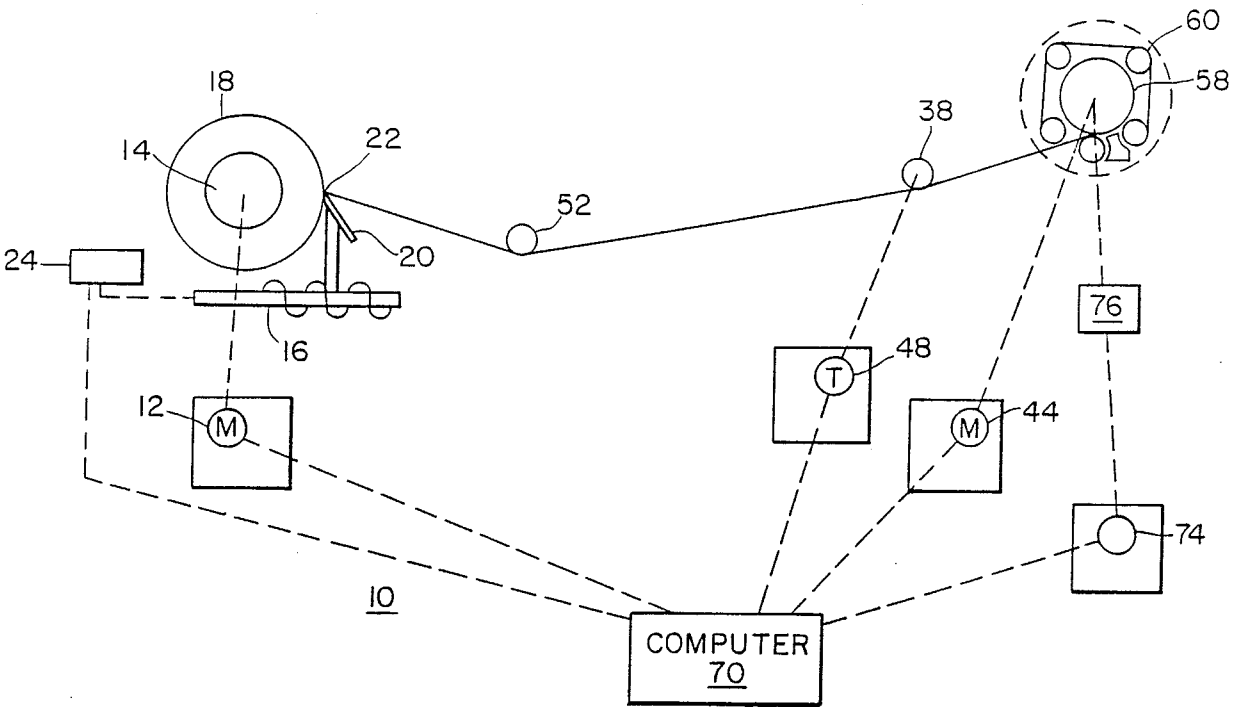
FIG. 1 is a schematic drawing of a strip peeling machine and related control systems.

Referring to FIG. 1, there is shown a simplified block diagram of a control system 10 for a peeling machine having a variable speed d.c. drive motor 12 arranged to rotate a main spindle 14. The main spindle 14 is adapted to provide a stable support for a billet 18 of the material to be peeled, such as metal. The lead screw 16 positions and drives a cutting tool 20 suitable for cutting the material of the billet 18.

When the billet 18 is securely mounted on the spindle 14, the motor 12 is operated so as to rotate the spindle 14 at a predetermined rate of speed which varies during the course of the peeling process. The lead screw 16 is driven by another d.c. motor 24 in a direction that feeds or advances a cutting edge 22 on the cutting tool 20 into the surface of the rotating billet 18 to produce a metal strip 30. A coolant (not shown) is often sprayed onto the tool and strip to control the temperature of the tool and strip.

A tachometer 48 monitors the speed of the strip 30 at some point between the cutting tool and a coiler mandrel 58. It is preferable that the strip speed be constant during peeling to provide uniformity in the peeled strip. Note that this requires that the spindle 14 must rotate faster as the ring or billet 18 becomes smaller during the peeling operation. The feed rate of the cutting tool 20 must also be increased to maintain strip speed as the radial thickness of the billet 18 is reduced.

The rate of advancement of the cutting tool 20 or feed rate is controlled by a d.c. motor 24 which is synchronized with the speed of the main spindle 14 and the tension on the strip. The motor 24 is adapted to permit an operator to select one of several discrete feed rates suitable for a particular operation. Alternatively, the feed rate of the tool could be separately driven and controlled along with the other drive motors by a computer system 70. The computer 70 has a memory that can be programmed with specific values for each of the drive motor speeds during the course of the entire peeling process.

Generally strip thickness runs between 100 and 200 microns depending upon the particular application. Depending upon the alloy composition, the peeled material can be quite brittle and may crack if not properly handled. The peeled thickness can be controlled to within 5% of the total strip thickness.

It has been determined that the resultant strip thickness is generally not equal to the depth of the cut or infeed of the cutting tool 20 into the peripheral surface of the billet. During the cutting operation, the material ahead of the cutting tool 20 is plastically compressed causing a cut strip to "gather" up to two and one half times the thickness of the depth of cut. The ratio of the resultant strip thickness to the depth of cut is termed "gather ratio". The gather ratio is dependent upon the material being cut, the tool rake angle, the cutting speed, and the tension applied to the material being cut from the billet 18. Increasing the tension applied to the strip 30 lowers the gather ratio and reduces the resultant thickness of the strip 30 by placing the strip material under tensile stress and thereby decreasing the plastic compression tendencies ahead of the cutting edge. Therefore, the greater the tension that is applied to the strip 30, the thinner the strip 30 becomes and the faster it travels. Conversely, lowering the tension decreases the tensile stress in the strip 30 and allows it to thicken and travel slower. It is also possible to obtain a thin strip by using both a slow cutting tool feed and low strip tension. Thus, the gather ratio is also the ratio of the surface speed of the billet, $B_{SS}$, to the speed of the strip, LS. Note that the gather ratio equals the ratio of billet surface speed/strip speed which equals the ratio of thickness/feed rate.

Electronic circuits are arranged to maintain a uniform strip thickness by controlling the ratio of the billet surface speed to the strip speed since the strip thickness is substantially equal to the product of the cutting tool feed rate multiplied by the gather ratio.

Synchronization of the spindle speed, tool traverse rate, capstan speed, and the wind-up coiler speed is performed by a programmable computer control system 70. The d.c. drive motors 12, 24 and 44 for the main spindle 14, the cutting tool and the coiler mandrel 58 respectively, are all controlled by computer 70. A tachometer 48 is used to monitor the speed of the strip 30 using roller 38 positioned between the guide roll 52 and the coiler mandrel 58. The memory of the computer 70 is used to compare the sensed parameters of the peeled strip to certain programmed values and adjust the speed of the different drive motors to maintain the sensed parameters within predetermined ranges. A programmed shutdown of the machine occurs at a predetermined end point in the cutting of the ring.

A torque meter 74 is connected to the coiler which measures the magnitude of the torque exerted by the coiler 58 on the strip 30. If there is a sudden loss in torque and no signal from tachometer 48, the computer overrides the tool feed motor 24 and withdraws the tool 20 from the billet 18. An additional sensor 76 detects the initial wrap of the strip 30 onto the coiler and actuates the torque meter 74.

In operation, the strip 30 is threaded by hand at a reduced rate onto mandrel 58 using an automatic wrapping device. The strip 30 is cut or peeled from the billet surface which is rotated against the cutting edge 22 of the cutting tool 20. The cut strip 30 is manually threaded about a first roller 50, and around a second roller 38 before reaching the automatic wrapping device. The process of threading the coiler is more fully described in connection with FIG. 2 in which the automatic wrapping assembly is shown. The automatic wrapping device includes a belt wrapper assembly 60 and a movable lower shear blade assembly 80. The blade assembly 80 is attached to a reciprocally movable mount (not shown). The belt wrapper assembly 60 includes a strip guide 84, an upper shear blade 86 having a cutting edge 88 and a continuous belt 90 looped around a plurality of rollers 92, 94, 96 and 98. The strip guide 84 and the rollers 92, 94, 96 and 98 are arranged on a mount so that an outside surface 102 of the belt 90 may be wrapped in tension around the mandrel 58, with the strip guide 84 on one side and the upper shear blade 86 on an opposite side of the mandrel, whereby the rotating mandrel 58 moves the belt 90 around the rollers 92, 94, 96 and 98. The shear blade assembly 80 comprises a pinch drive roller 104 and a lower shear blade 106 cooperatively assembled on the mount with bias means, such as a coil spring 105. The coil spring is arranged to urge the pinch drive roller 104 toward an uncovered portion 107 of the mandrel 58, and a cutting edge 108 of the lower shear blade 106 to slide past the cutting edge 88 of the upper shear blade 86.

Figure 2:
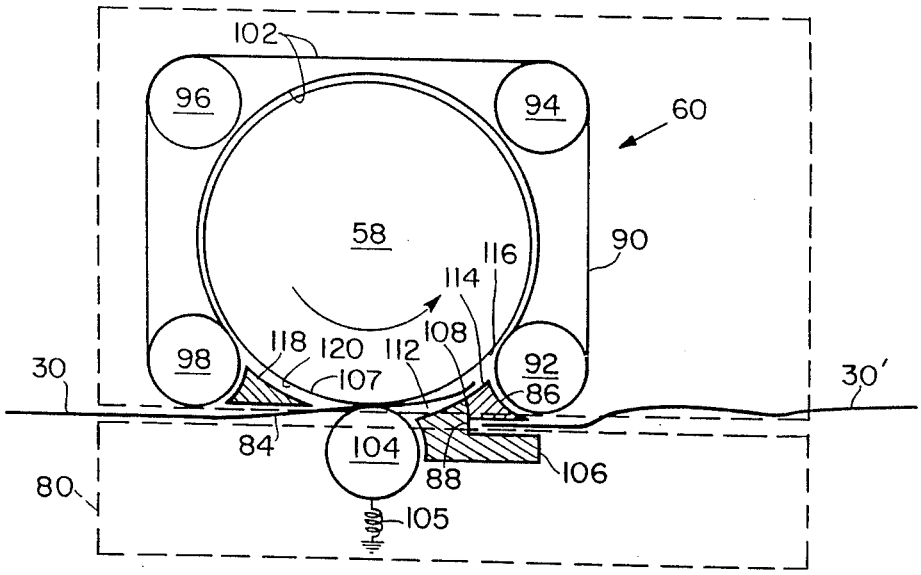
FIG. 2 shows a detailed side view of a coil wrapping device.

Under operating conditions, the moving strip of material 30 is passed between the motor driven mandrel 58 and the lower shear blade assembly 106. The bias means 105 is operable to urge the pinch drive roller 104 against the strip material 30, squeezing it against the exposed surface 107 of the rotating mandrel 58. Simultaneously, the bias means 105 causes the cutting edge 108 of the lower shear blade 106 to slide past the cutting edge 88 of the upper shear blade 86 to shear a section 30, from the strip material, as shown in FIG. 2. Complementary curved surfaces 112 and 114 of the lower and upper shear blades 106, 86 respectively, form a second strip guide for immediately directing the remaining strip material 30 toward the similarly curved surface 116 of the mandrel 58 for coiling. The pinch drive roller 104 and the lower shear blade 106 are cooperatively arranged so that the pinch drive roller 104 acts as a means for smoothly merging the curved surface 112 of the lower shear blade 106 with the curved surface 114 of the upper shear blade 86 to form the second strip guide, after shearing of the strip material is completed. Thus, coiling of the strip material 30 around the mandrel 58 begins substantially simultaneously with shearing, to avoid twisting of the strip material 30. The strip material 30 is pushed between the outside belt surface 102 and the mandrel 58 by the rotating pinch drive roller 104. The strip is thus caught and pulled around the mandrel 58. Curved surface 118 of the first strip guide 84 and a similarly curved mandrel surface 120 function to keep the strip 30 directed toward the junction between pinch roller 104 and mandrel outer surface 120.

Figure 3:
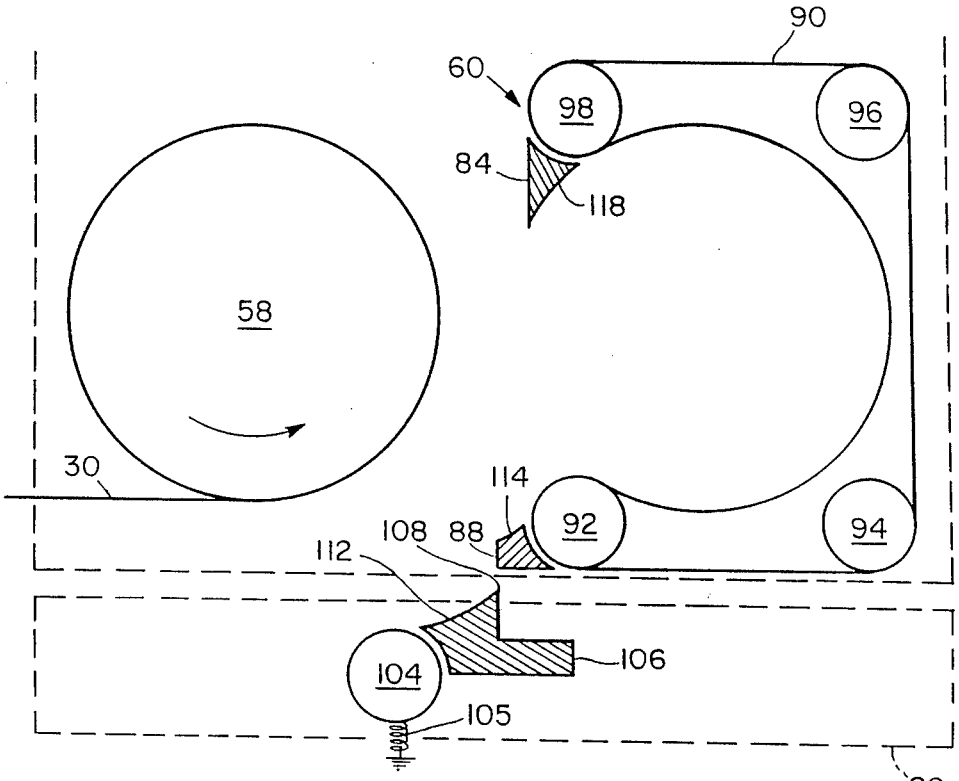
FIG. 3 shows a side view of the coiler assembly after withdrawal of the wrapping device.

After a suitable amount of the strip material 30 is wrapped several times around the mandrel 58, the apparatus is moved to a retracted position, away from the mandrel 58, as shown in FIG. 3. The sensor 76 detects the frictional engagement between the strip 30 and the mandrel that occurs at some point during this initial wrap or is signaled by the operator moving the belt wrapper away from the mandrel. The belt wrapper assembly 60 and the lower shear blade assembly 80 are attached to mount adapted to movement toward and away from the mandrel 58. The mandrel 58 is rotatably driven by the variable speed d.c. motor 44 shown in FIG. 1. Tension is applied to the strip 30 as it is being wrapped around the mandrel 58 during threading of the strip 30. The mandrel 58 pulls the strip 30 as it rotates about its longitudinal axis and wraps the strip 30 around itself. If the strip were to break at this time, the torque meter would sense the loss of tension and the computer 70 would interrogate the tachometer 48 to determine if there is no rotation of the friction roller 38. A reading of no rotation results in the withdrawal of the tool from the billet and termination of the peeling process. The operator must then remove the broken strip from the coiler and initiate cutting of a new strip from the billet.

After threading, the machine is switched into run mode and the strip speed is accelerated to a speed of about 60 meters/minute or faster depending upon the strip properties desired. The pulling force or tension applied to the strip 30 is an important factor determinative of the strip thickness and shape. This force is a longitudinal tensile force applied on a plastic deformation zone in the strip at the cutting point. This applied force equalizes the non-uniform strains resulting from the metal cutting operation. A typical value for the peeling tension is about 250lbs.

Although the invention has been described in connection with certain preferred embodiments, it should be clear that various changes and modifications can be made without departing from the spirit and scope of the claimed invention. For example, a wide variety of systems may be employed in driving and controlling the tensioning system described herein.

I claim:

1. A method of controlling the threading of a strip peeling machine comprising:

rotating a billet of material to be peeled on a spindle at a threading speed;

cutting the billet with a tool at a threading rate to produce a strip of peeled material;

wrapping the peeled strip onto a coiler;

monitoring the tension of the strip between the coiler and the billet during threading of the strip;

terminating cutting of the billet during the threading of the strip when a predetermined reduction in tension in the strip between the coiler and the billet occurs; and repeating the previous steps of the method if cutting is terminated or, alternatively, discontinuing the threading of the strip onto the coiler and accelerating the rate of cutting of the billet with the tool to a peeling speed.

2. The method of threading of claim 1 wherein said monitoring step comprises sensing the torque applied to the coiler by the peeled strip.

3. The method of threading of claim 1 wherein said monitoring step further comprises sensing the speed of a roller contacting the strip between the cutting tool and the coiler.

4. The method of threading of claim wherein the termination of cutting comprises displacing a cutting tool away from the billet.

5. The method of threading of claim 1 wherein said wrapping step further comprises sensing that the strip has been wrapped onto the coiler.

6. The method of threading of claim 5 wherein the sensing of the wrapped strip actuates a torque meter to measure the torque applied to the coiler by the strip.

7. A control system for a strip peeling machine comprising:

a rotatable billet;

a cutting tool to peel a strip from the billet at a threading speed or a peeling speed;

a coiler having a threading position and a peeling position to take up the peeled strip such that the strip is under tension between the billet and the coiler;

a sensor adjacent the coiler in the threaded position that detects a reduction in the tension during threading of the peeled strip and generates a signal when the coiler is in the threaded position that is correlated with the reduction in tension; and a controller responsive to the signal that discontinues cutting of the strip from the billet at the threading speed upon the detected reduction in threading tension.

8. The control system of claim 7 wherein the controller actuates a circuit that displaces the tool away from the billet to discontinue cutting of the billet.

9. The control system of claim 7 further comprising a second sensor for detecting a wrapping of the coiler with the peeled strip.

10. The control system of claim 9 wherein the tension sensor is activated by a signal from the second sensor indicating that the strip has been wrapped on the coiler.

11. The control system of claim 7 wherein the sensor comprises a torque meter to measure a torque exerted by the strip on the coiler.

12. The control system of claim 7 further comprising a data processor having a memory in which a predetermined value of tension reduction is placed that is compared with the detected reduction in tension.

13. The control system of claim 7 further comprising a roller positioned between the cutting tool and the coiler and in contact with the strip during threading and a tachometer coupled to the roller to indicate the speed of the strip.

14. The control system of claim 13 wherein the controller discontinues peeling of the billet upon a detected reduction in the speed of the strip as indicated by the tachometer.

* * * * *